US008087561B2

(12) United States Patent
Lee

(10) Patent No.: US 8,087,561 B2
(45) Date of Patent: Jan. 3, 2012

(54) POWDER-ACTUATED FASTENER-DRIVING DEVICE CAPABLE OF POWER ADJUSTMENT

(76) Inventor: Cheng-Ho Lee, Taipei (TW)

( * ) Notice: Subject to any disclaimer, the term of this patent is extended or adjusted under 35 U.S.C. 154(b) by 288 days.

(21) Appl. No.: 12/582,649

(22) Filed: Oct. 20, 2009

(65) Prior Publication Data

US 2010/0258609 A1 Oct. 14, 2010

(30) Foreign Application Priority Data

Apr. 9, 2009 (TW) ..... 98205755 U

(51) Int. Cl.
*B25C 1/14* (2006.01)

(52) U.S. Cl. ..... 227/10; 227/9

(58) Field of Classification Search ..... 227/9, 10; 89/1.14

See application file for complete search history.

(56) References Cited

U.S. PATENT DOCUMENTS 3,652,003 A * 3/1972 Leonardo et al. ..... 227/10
3,860,161 A * 1/1975 Engstrom et al. ..... 227/10
4,053,094 A * 10/1977 Males ..... 227/93
4,153,192 A * 5/1979 Jochum ..... 227/10
4,382,533 A * 5/1983 Buechel et al. ..... 227/10
4,687,126 A * 8/1987 Brosius et al. ..... 227/10
4,711,385 A * 12/1987 Jochum ..... 227/10
5,471,903 A * 12/1995 Brede et al. ..... 89/1.14
5,699,948 A * 12/1997 Lee ..... 227/10
5,799,855 A * 9/1998 Veoukas et al. ..... 227/10
5,842,623 A * 12/1998 Dippold ..... 227/10
7,322,503 B2 * 1/2008 Odoni et al. ..... 227/10
2006/0266206 A1 * 11/2006 Lund et al. ..... 89/7

* cited by examiner

*Primary Examiner* — Brian D Nash
(74) *Attorney, Agent, or Firm* — Pepper Hamilton LLP

(57) ABSTRACT

A powder-actuated fastener-driving device includes a barrel mounted in a housing. The barrel has a barrel wall formed with a through hole communicating with a radial vent hole. The through hole and the vent hole constitute an exhaust passage. A driving piston is mounted movably within the barrel, and has a rear end portion cooperating with an inner annular surface of the barrel wall to define an annular gap therebetween. A power adjusting unit includes an adjusting member disposed movably in the housing, and operable to move a control end portion thereof within the through hole so as to control an effective open area of the exhaust passage such that combustion gases discharge from a firing chamber defined between the driving piston and a rear end portion of the barrel through the gap and the effective open area, thereby controlling venting of combustion gases from the firing chamber.

10 Claims, 9 Drawing Sheets

POWDER-ACTUATED FASTENER-DRIVING DEVICE CAPABLE OF POWER ADJUSTMENT

CROSS-REFERENCE TO RELATED APPLICATION

This application claims priority of Taiwanese Application No. 098205755, filed on Apr. 9, 2009.

BACKGROUND OF THE INVENTION

1. Field of the Invention

The invention relates to a fastener-driving device, more particularly to a powder-actuated fastener-driving device capable of power adjustment.

2. Description of the Related Art

A conventional powder actuated tool disclosed in U.S. Pat. No. 6,032,846 is capable of power adjustment by controlling venting of combustion gases from a firing chamber. In the conventional powder actuated tool, at least two radial passages directly communicate with the firing chamber. The two radial passages are required to provide adequate power adjustment range and acceptable linear power adjustment with movement of a control member.

SUMMARY OF THE INVENTION

Therefore, an object of the present invention is to provide a powder-actuated fastener-driving device that is capable of adequate power adjustment.

According to the present invention, a powder-actuated fastener-driving device comprises:

a housing having a front open end;

a barrel mounted movably in the housing, and having a rear end portion that defines a powder load chamber adapted for accommodating powder load therein, and a barrel wall formed with a through hole extending from the rear end portion in an axial direction, and a vent hole extending radially from an inner annular surface thereof, disposed adjacent to the rear end portion and in spatial communication with the through hole, the vent hole cooperating with the through hole to constitute an exhaust passage;

a driving piston mounted movably within the barrel and adapted for driving a fastener upon detonation of the powder load in the powder load chamber, the driving piston having a rear end portion that has a small-diameter section disposed adjacent to the rear end portion of the barrel and having a diameter slightly smaller than an inner diameter of the barrel such that an annular gap is defined between the small-diameter section and the inner annular surface of the barrel wall, and a large-diameter section having a diameter larger than that of the small-diameter section and substantially equal to the inner diameter of the barrel such that the large-diameter section abuts against the inner annular surface of the barrel wall, a firing chamber being defined between the rear end portion of the barrel and the small-diameter section of the rear end portion of the driving piston, and communicating with the vent hole through the annular gap upon detonation of the powder load in the powder load chamber; and a power adjusting unit for adjusting power acted on the driving piston by controlling venting of combustion gases from the firing chamber, the power adjusting unit including an adjusting member disposed movably in the housing and having a control end portion extending into the through hole in the barrel wall.

The adjusting member is operable to move the control end portion within the through hole in the barrel wall so as to control an effective open area of the exhaust passage such that combustion gases discharge from the firing chamber through the annular gap and the effective open area of the exhaust passage, thereby controlling venting of combustion gases from the firing chamber.

BRIEF DESCRIPTION OF THE DRAWINGS

Other features and advantages of the present invent ion will become apparent in the following detailed description of the preferred embodiment with reference to the accompanying drawings, of which.

DETAILED DESCRIPTION OF THE PREFERRED EMBODIMENT

Figure 1:
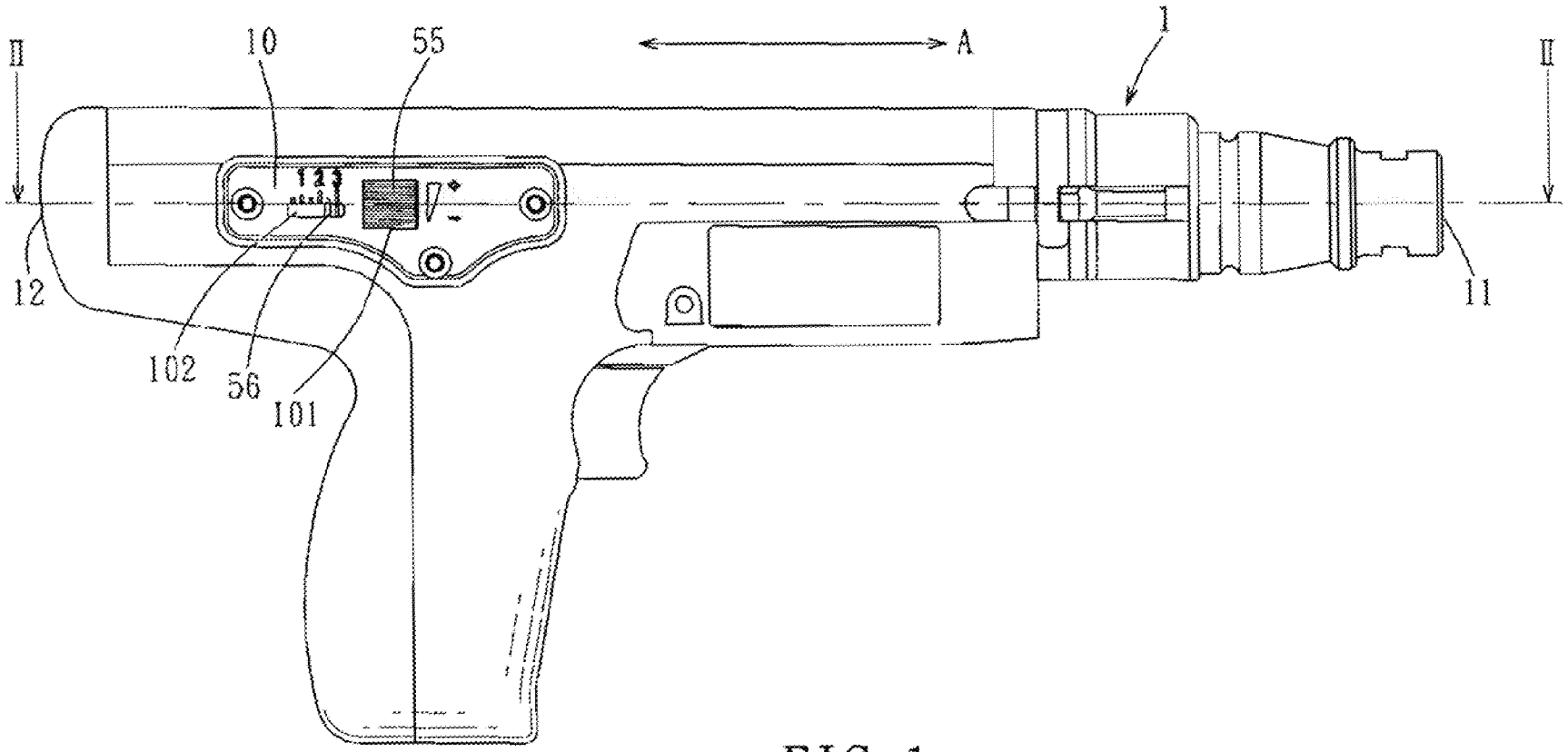
FIG. 1 is a schematic side view showing the preferred embodiment of a powder-actuated fastener-driving device according to the present invention.
Figure 2:
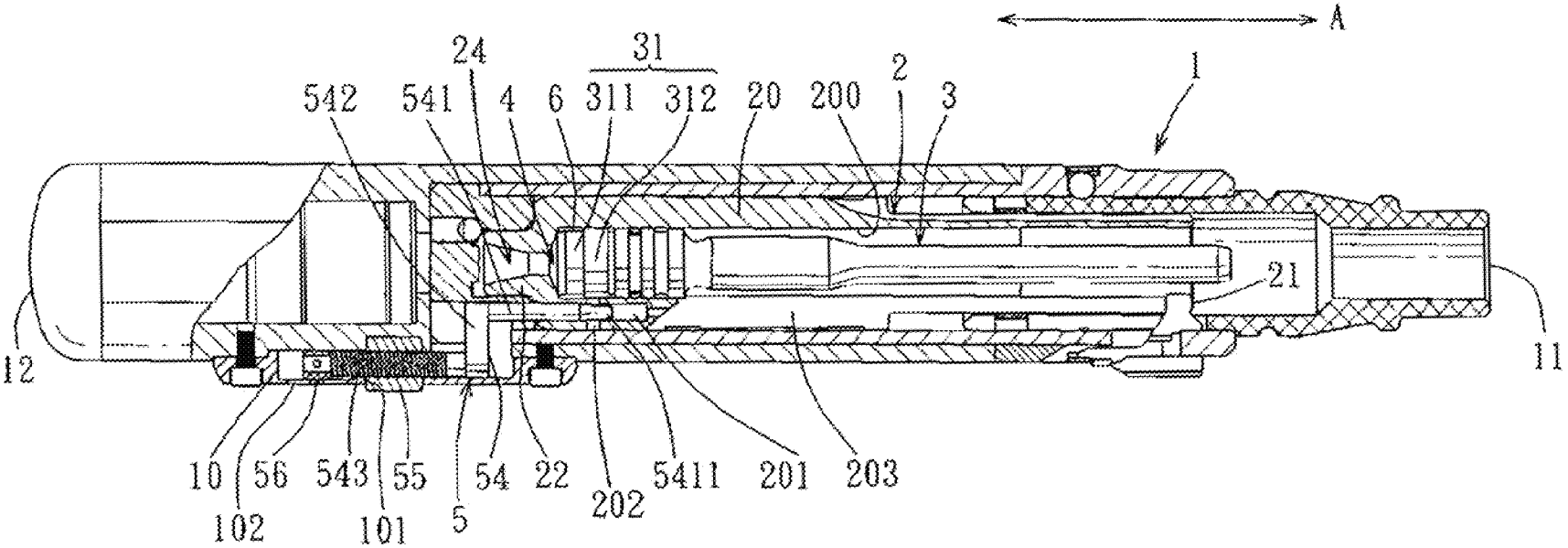
FIG. 2 is a partly schematic sectional view of the preferred embodiment taken along line II-II in FIG. 1.
Figure 3:
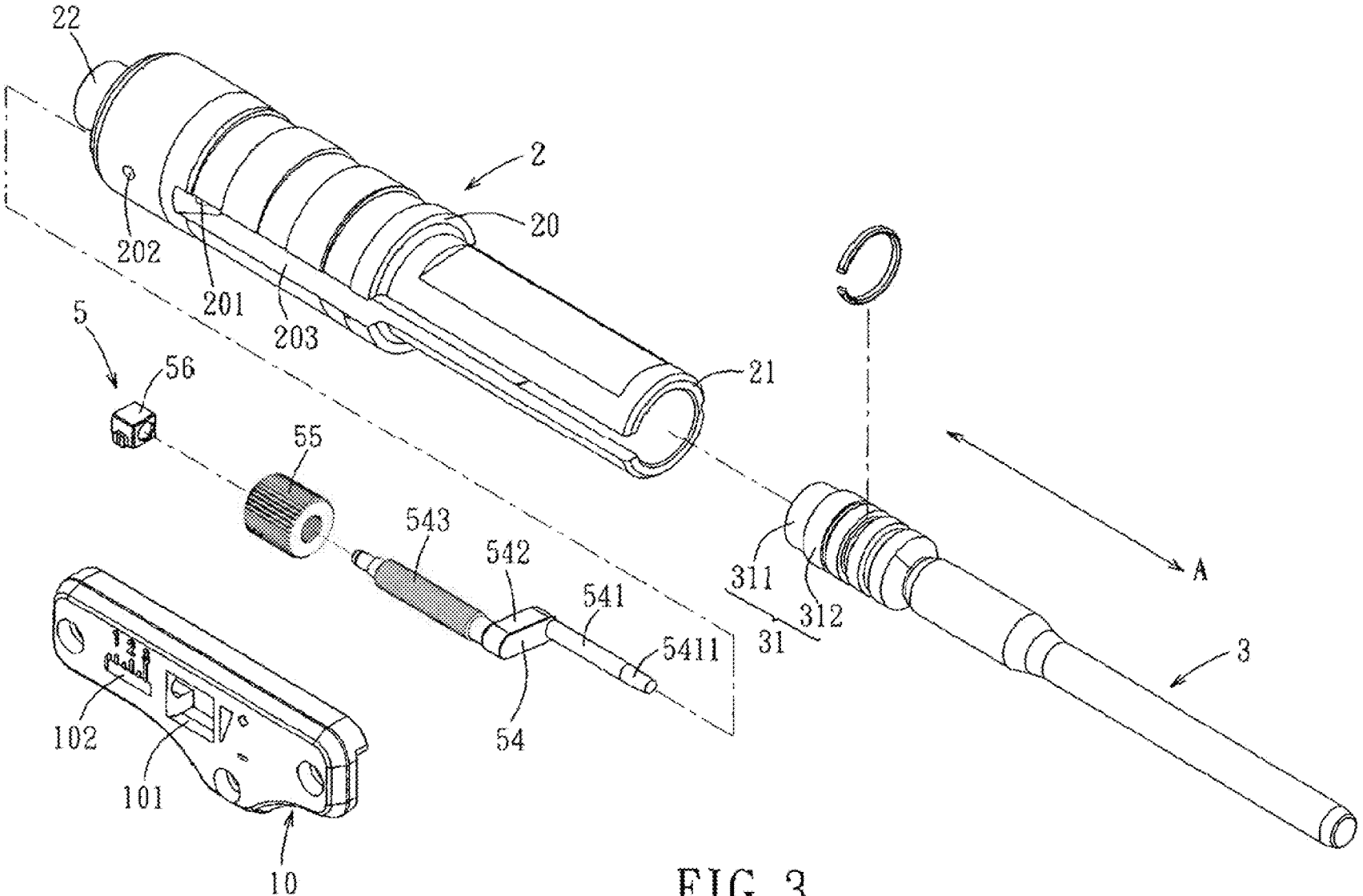
FIG. 3 is an exploded perspective view showing a barrel, a driving piston, a power adjusting unit and a mounting panel of the preferred embodiment.

Referring to FIGS. 1 to 3, the preferred embodiment of a powder-actuated fastener-driving device according to the present invention is shown to include a housing 1, a barrel 2, a driving piston 3, and a power adjusting unit 5.

The housing 1 is in the form of a gun body in this embodiment, and has a front open end 11 and a rear end 12 opposite to each other in an axial direction (A). In this embodiment, the housing 1 has a mounting panel 10 disposed adjacent to the rear end 12 and formed with a mounting hole 101 and an indicating hole 102.

The barrel 2 is mounted movably in the housing 1, and has a rear end portion 22 that defines a powder load chamber 24 adapted for accommodating powder load (not shown) therein. The powder load can be in the form of a bullet. The barrel 2 has a barrel wall 20 formed with a through hole 201 extending from the rear end portion 22 in the axial direction (A), a vent hole 202 extending radially from an inner annular surface 200 thereof, disposed adjacent to the rear end portion 22 and in spatial communication with the through hole 201, and a slot 203 extending from a front end 21 of the barrel 2 in the axial direction (A) and in spatial communication with the through hole 201, as shown in FIGS. 2 and 3. It is noted that the vent hole 202 cooperates with the through hole 201 to constitute an exhaust passage.

Figure 6:
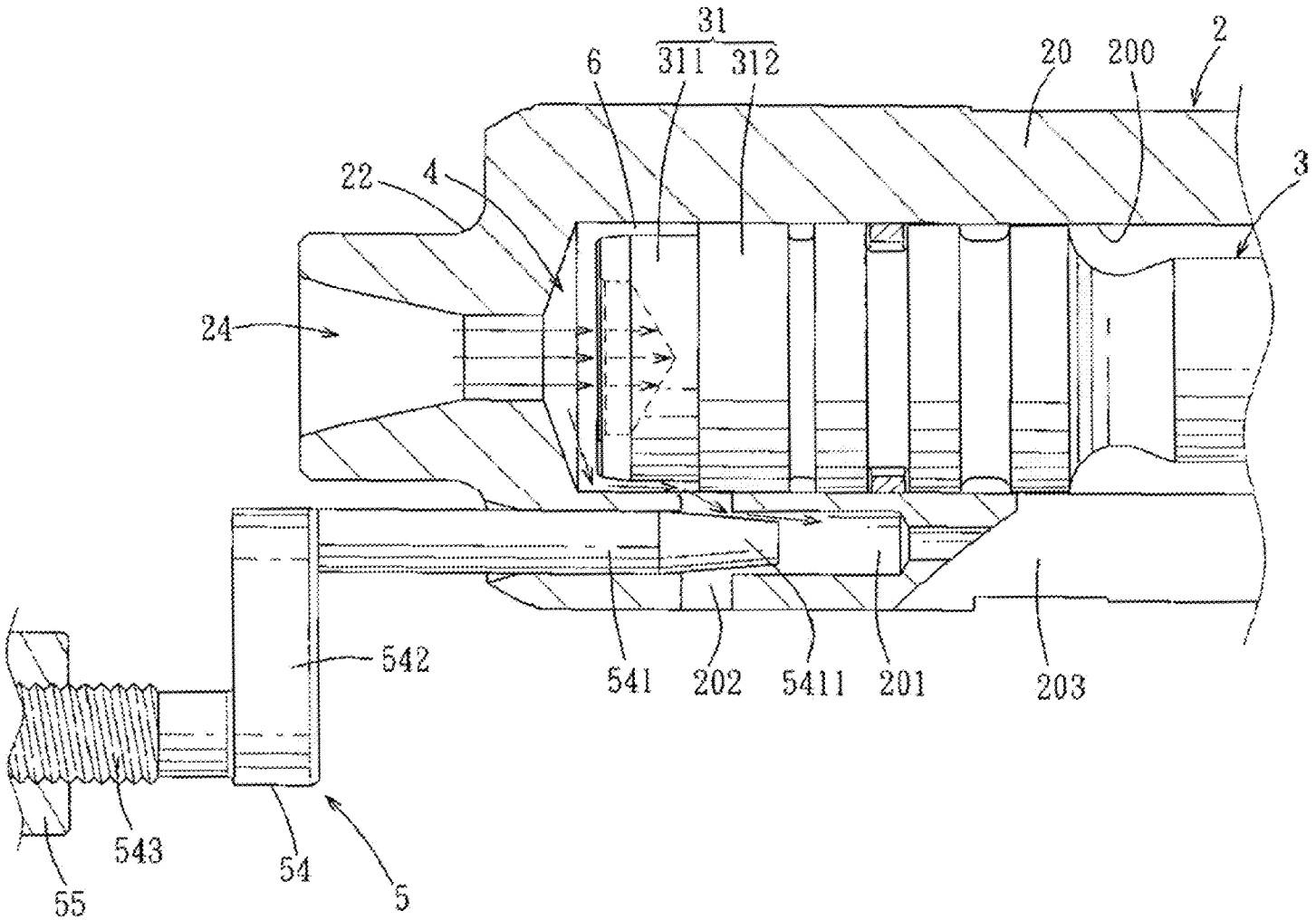
FIGS. 6 and 7 are fragmentary, partly schematic sectional views illustrating movement of the driving piston upon detonation of powder load when the adjusting member is at the medium-power position.
Figure 7:
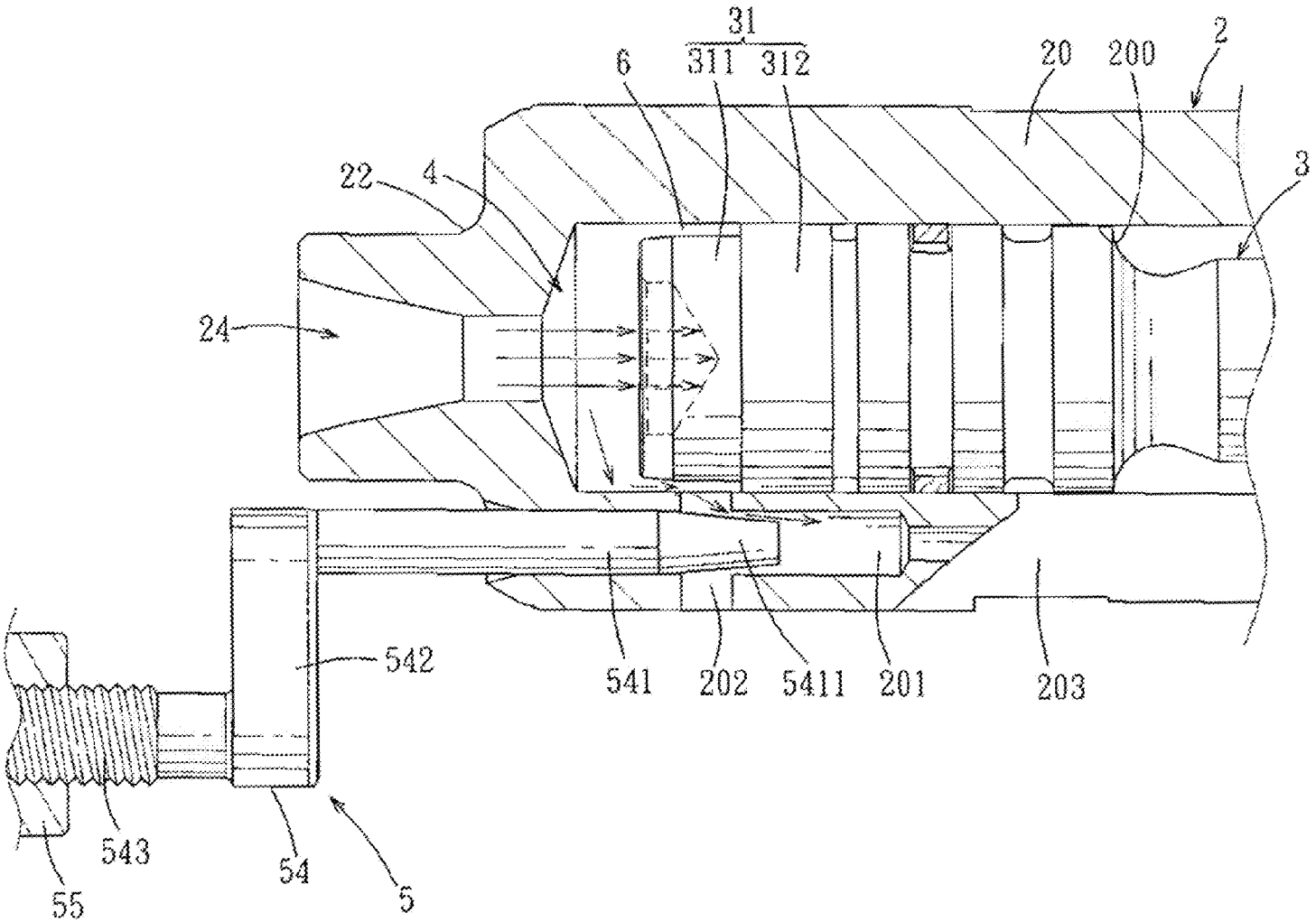

The driving piston 3 is mounted movably within the barrel 2, and is adapted for driving a fastener (not shown), such as a nail, into a substrate (not shown) upon detonation of the powder load in the powder load chamber 24. The driving piston 3 has a rear end portion 31 that has a small-diameter section 311 and a large-diameter section 312 connected to each other. The small-diameter section 311 is disposed adjacent to the rear end portion 22 of the barrel 2, and has a diameter slightly smaller than an inner diameter of the barrel 2 such that an annular gap 6 is defined between the small-diameter section 311 and the inner annular surface 200 of the barrel wall 20, as shown in FIG. 2. In this embodiment, the annular gap 6 has a width ranging from 0.5 mm to 2 mm. The large-diameter section 312 has a diameter larger than that of the small-diameter section 311 and substantially equal to the inner diameter of the barrel 2 such that the large-diameter section 312 abuts against the inner annular surface 200 of the barrel wall 20. It is noted that the vent hole 202 in the barrel wall 20 is closed by the large-diameter section 312 of the rear end portion 31 of the driving piston 3 prior to detonation of the powder load in the powder load chamber 24. Thus, when the powder-actuated fastener-driving device is operated in a normal state, i.e., the powder load in the powder load chamber 24 is not detonated, the annular gap 6 does not communicate with the vent hole 202, as shown in FIG. 2. A firing chamber 4 is defined between the rear end portion 22 of the barrel 2 and the small-diameter section 311 of the rear end portion 31 of the driving piston 3, and communicates with the vent hole 202 through the annular gap 6 upon detonation of the powder load in the powder load chamber 24, as shown in FIGS. 6 and 7.

The power adjusting unit 5 adjusts power acted on the driving piston 3 by controlling venting of combustion gases from the firing chamber 4. The power adjusting unit 5 includes an adjusting member 54, an operating ring 55 and an indicator 56.

Figure 9:
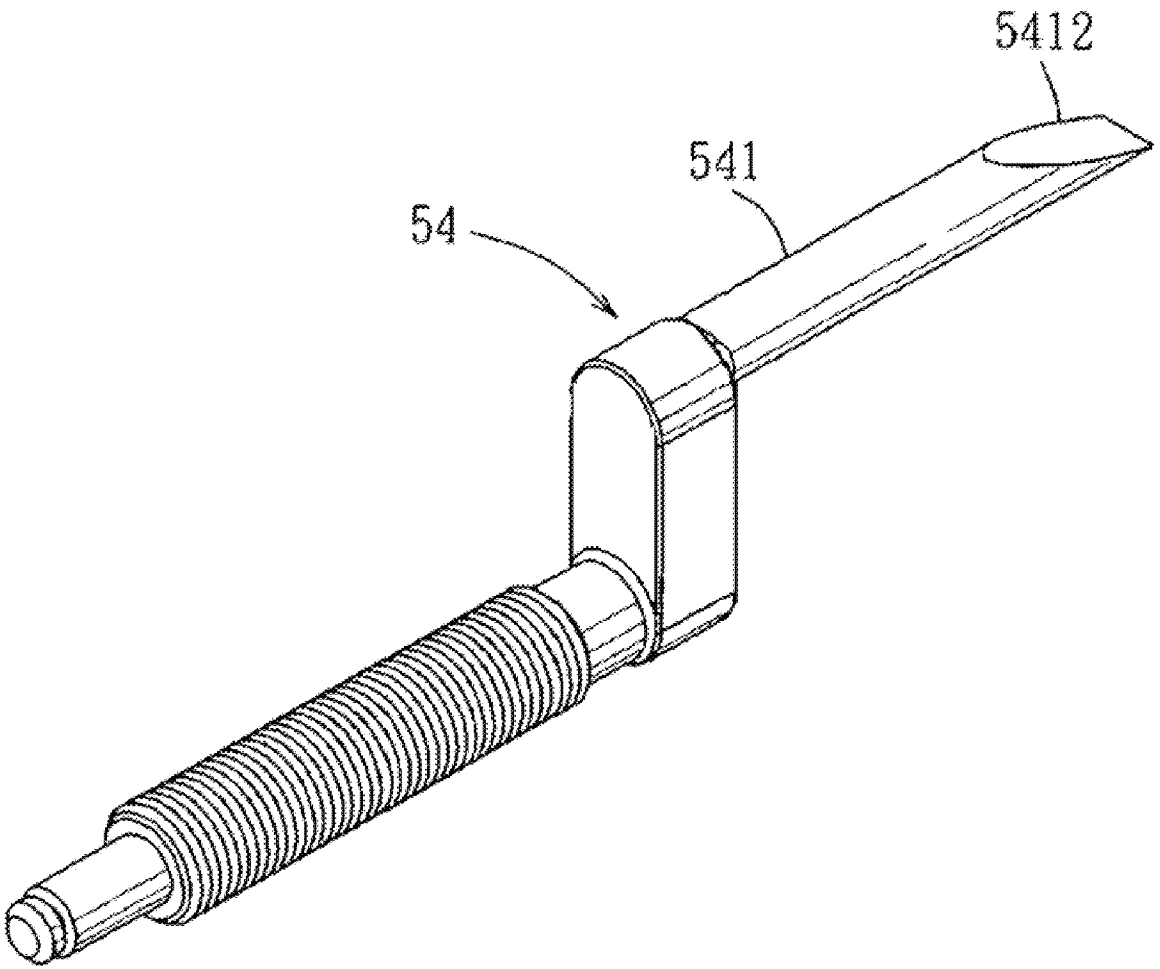
FIG. 9 is a perspective view of a variation of the adjusting member of the preferred embodiment.

The adjusting member 54 is disposed movably in the housing 1, and has a control end portion 541 in the form of a rod and extending into the through hole 201 in the barrel wall 20, a threaded end portion 543 opposite to the control end portion 541 in the axial direction (A), and an intermediate portion 542 interconnecting and perpendicular to the control end portion 541 and the threaded end portion 543. The adjusting member 54 is operable to move the control end portion 541 within the through hole 201 in the barrel wall 20 so as to control an effective open area of the exhaust passage such that combustion gases discharge from the firing chamber 4 through the annular gap 6 and the effective open area of the exhaust passage, thereby controlling venting of combustion gases from the firing chamber 4. In this embodiment, the adjusting member 54 is movable among a maximum-power position, a medium-power position and a minimum-power position. The control end portion 541 has a frusto-conical front end 5411. Alternatively, the control end portion 541 has a front end 5412 with a chamfer, as shown in FIG. 9.

The operating ring 55 is sleeved on and is connected threadedly to the threaded end portion 543 of the adjusting member 54, and is mounted on the mounting panel 10 of the housing 1. The operating ring 55 is partially exposed from the mounting panel 10 via the mounting hole 101. The operating ring 55 is rotatable relative to the threaded end portion 543 of the adjusting member 54 so as to cause movement of the adjusting member 54 relative to the operating ring 55 in the axial direction (A). In this embodiment, upward rotation of the operating ring 55, as indicated by a symbol "+" printed on the mounting panel 10, causes movement of the adjusting member 54 toward the front open end 11 of the housing 1, thereby decreasing the effective open area of the exhaust passage, i.e., increasing power acted on the driving piston 3. On the other hand, downward rotation of the operating ring 55, as indicated by a symbol "−" printed on the mounting panel 10, causes movement of the adjusting member 54 toward the rear end 12 of the housing, thereby increasing the effective open area of the exhaust passage, i.e., decreasing power acted on the driving piston 3.

The indicator 56 is connected to one end of the threaded end portion 543 of the adjusting member 54, and is partially exposed from the mounting panel 10 via the indicating hole 102 for indicating power information based on movement of the adjusting member 54. In this embodiment, the indicator 56 is movable within the indicating hole 102. When the indicator 56 is at a first position, as indicated by a symbol "1" printed on the mounting panel 10, the adjusting member 54 is at the minimum-power position. When the indicator 56 is at a second position, as indicated by a symbol "2" printed on the mounting panel 10, the adjusting member 54 is at the medium-power position. When the indicator 56 is at a third position, as indicated by a symbol "3" printed on the mounting panel 10, the adjusting member 54 is at the maximum-power position.

Figure 4:
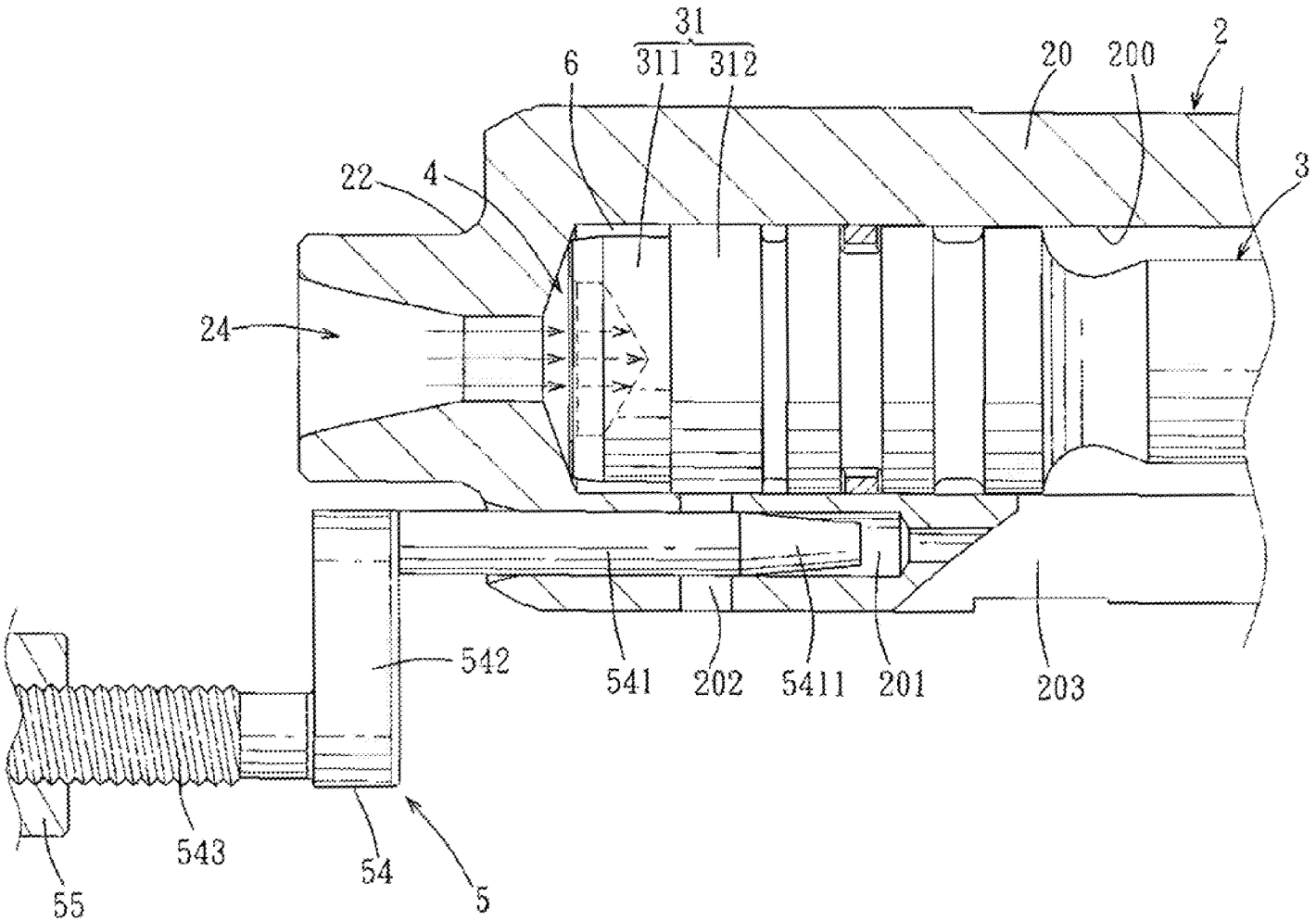
FIG. 4 is a fragmentary, partly schematic sectional view showing the preferred embodiment when an adjusting member is at a maximum-power position.
Figure 5:
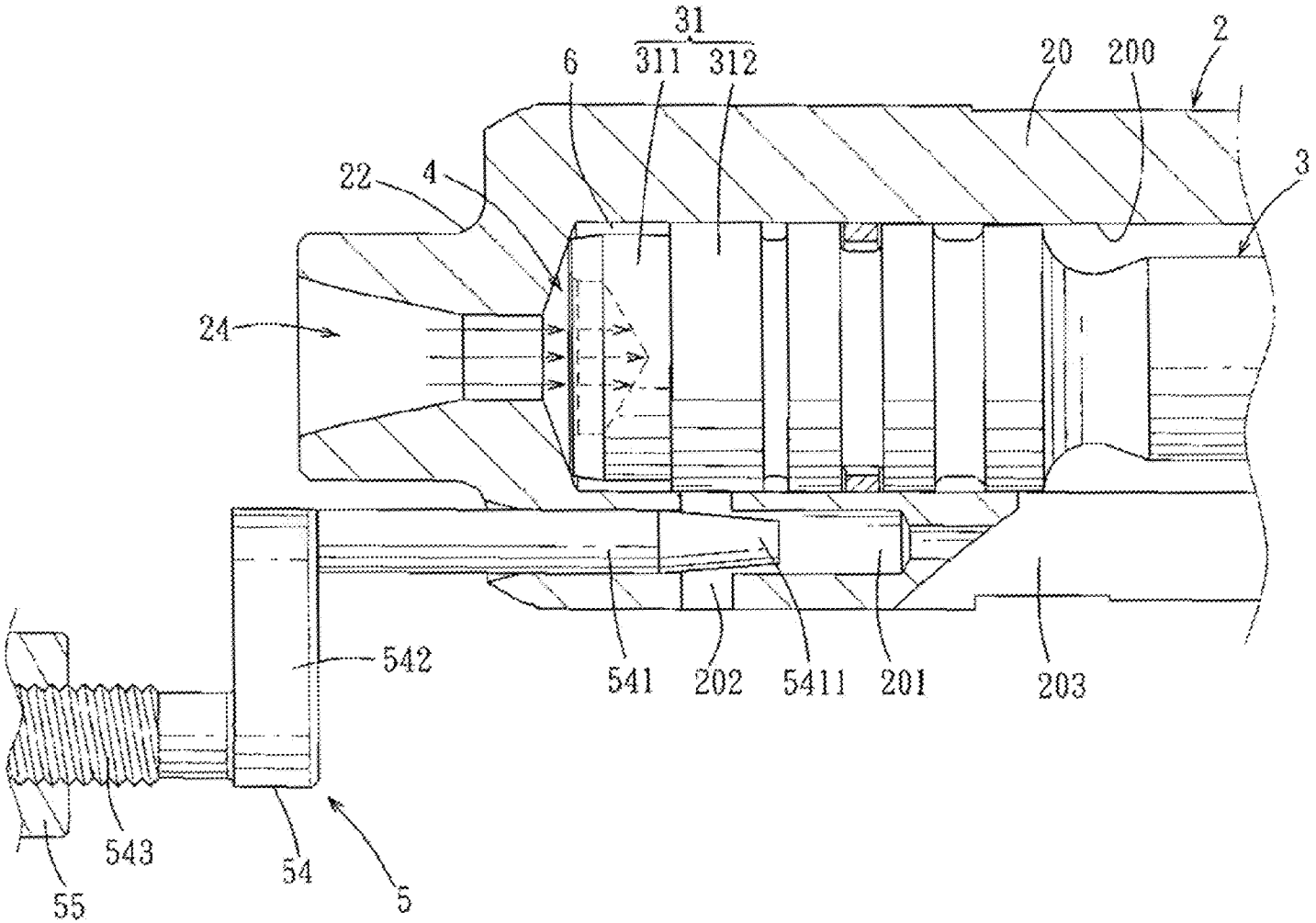
FIG. 5 is a fragmentary, partly schematic sectional view showing the preferred embodiment when the adjusting member is at a medium-power position.
Figure 8:
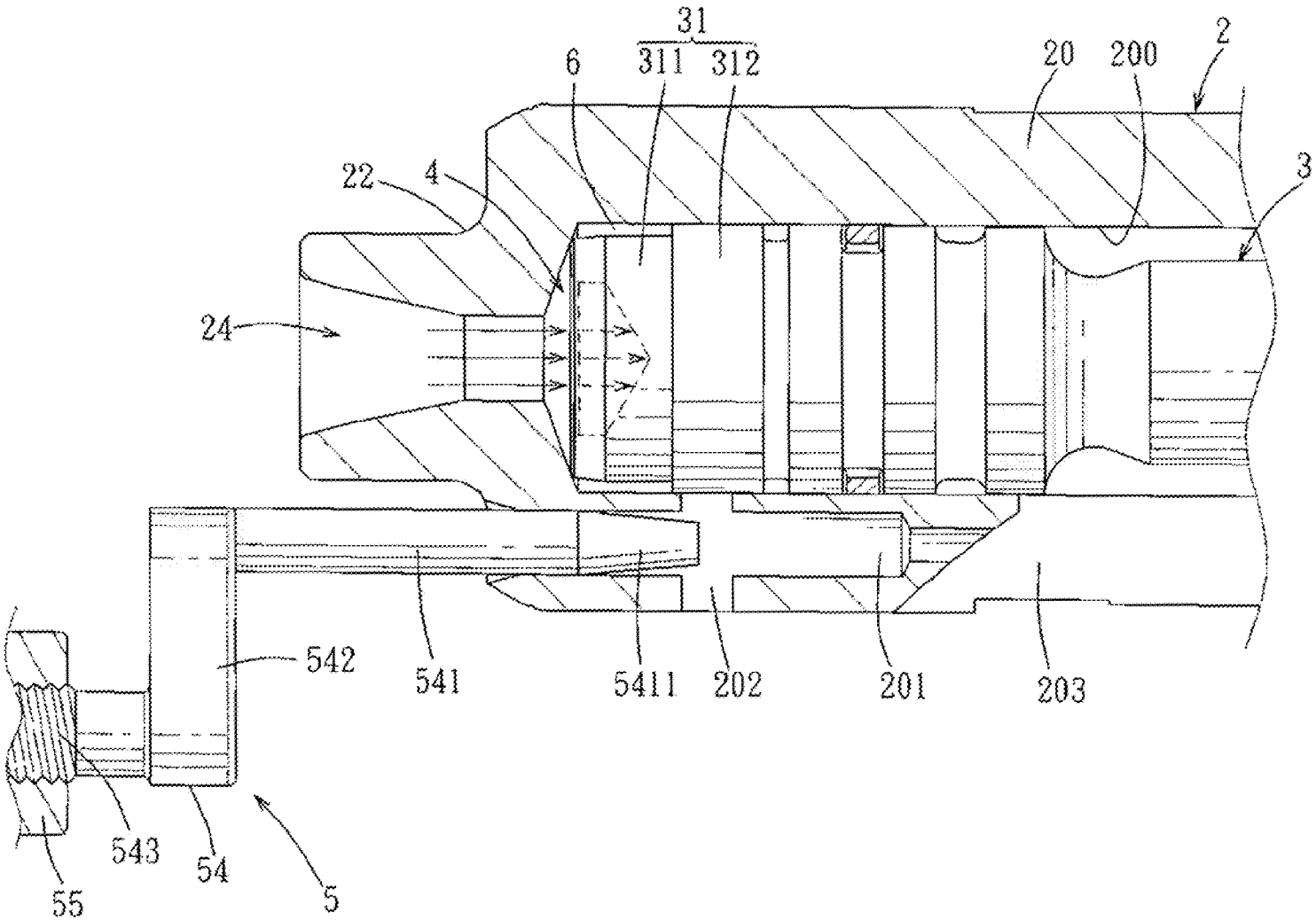
FIG. 8 is a fragmentary, partly schematic sectional view showing the preferred embodiment when the adjusting member is at a minimum-power position.

In use, when the adjusting member 54 is at the maximum-power position, as shown in FIG. 4, an intersection of the through hole 201 and the vent hole 202 is fully blocked by the control end portion 541 of the adjusting member 54 such that no effective open area is formed. In this case, no discharge of combustion gases from the firing chamber 4 to the vent hole 202 occurs such that the powder-actuated fastener-driving device provides a maximum power for driving the fastener. When the adjusting member 54 is at the medium-power position, as shown in FIG. 5, the front end 5411 of the control end portion 541 of the adjusting member 54 is disposed across the vent hole 202 such that a part of the exhaust passage is blocked by the front end 5411 of the control end portion 541 of the adjusting member 54. Thus, a remaining part of the exhaust passage serves as the effective open area. In this case, upon detonation of the powder load in the powder load chamber 24, part of combustion gases discharge from the firing chamber 4 through the annular gap 6 and the effective open area, as indicated by arrows in FIGS. 6 and 7. The annular gap 6 can effectively further limit the amount of combustion gases to pass through the effective open area at the beginning stage of the detonation, as shown in FIG. 6, so as to control adequate combustion gases passing through the effective area and avoid too much power loss. Thus, the powder-actuated fastener-driving device provides a medium power for driving the fastener. When the adjusting member 54 is at the minimum-power position, as shown in FIG. 8, the front end 5411 of the control end portion 541 of the adjusting member 54 is moved away from the vent hole 202 such that the effective open area has a maximum area. In this case, upon detonation of the powder load in the powder load chamber 24, relatively greater discharge of combustion gases from the firing chamber 4 through the annular gap 6 and the effective open area occurs such that the powder-actuated fastener-driving device provides a minimum power for driving the fastener.

It is noted that, if the annular gap 6 does not exist, inadequate power adjustment range may incur or linear power adjustment with movement of the adjusting member 54 cannot be attained as a result of fast discharge of combustion gases.

In sum, due to the presence of the annular gap 6 and the frusto-conical front end 5411 of the control end portion 541 of the adjusting member 54, linear discharge of combustion gases from the firing chamber 4 can be ensured, and the powder-actuated fastener-driving device of the present invention can attain adequate power adjustment range and good linear power adjustment with movement of the adjusting member 54.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A powder-actuated fastener-driving device comprising:

a housing having a front open end;

a barrel mounted movably in said housing, and having a rear end portion that defines a powder load chamber adapted for accommodating powder load therein, and a barrel wall formed with a through hole extending from said rear end portion in an axial direction, and a vent hole extending radially from an inner annular surface thereof, disposed adjacent to said rear end portion and in spatial communication with said through hole, said vent hole cooperating with said through hole to constitute an exhaust passage;

a driving piston mounted movably within said barrel and adapted for driving a fastener upon detonation of the powder load in said powder load chamber, said driving piston having a rear end portion that has a small-diameter section disposed adjacent to said rear end portion of said barrel and having a diameter slightly smaller than an inner diameter of said barrel such that an annular gap is defined between said small-diameter section and said inner annular surface of said barrel wall, and a large-diameter section having a diameter larger than that of said small-diameter section and substantially equal to the inner diameter of said barrel such that said large-diameter section abuts against said inner annular surface of said barrel wall, a firing chamber being defined between said rear end portion of said barrel and said small-diameter section of said rear end portion of said driving piston, and communicating with said vent hole through said annular gap upon detonation of the powder load in said powder load chamber; and a power adjusting unit for adjusting power acted on said driving piston by controlling venting of combustion gases from said firing chamber, said power adjusting unit including an adjusting member disposed movably in said housing and having a control end portion extending into said through hole in said barrel wall;

wherein said adjusting member is operable to move said control end portion within said through hole in said barrel wall so as to control an effective open area of said exhaust passage such that combustion gases discharge from said firing chamber through said annular gap and the effective open area of said exhaust passage, thereby controlling venting of combustion gases from said firing chamber.

2. The powder-actuated fastener-driving device as claimed in claim 1, wherein said vent hole is closed by said large-diameter section of said rear end portion of said driving piston prior to detonation of the powder load such that said annular gap does not communicate with said vent hole.

3. The powder-actuated fastener-driving device as claimed in claim 1, wherein said annular gap has a width ranging from 0.5 mm to 2 mm.

4. The powder-actuated fastener-driving device as claimed in claim 1, wherein said barrel wall of said barrel is further formed with a slot extending from a front end of said barrel in the axial direction and in spatial communication with said through hole.

5. The powder-actuated fastener-driving device as claimed in claim 1, wherein:

said adjusting member further has a threaded end portion opposite to said control end portion in the axial direction and parallel to said control end portion; and said power adjusting unit further includes an operating ring sleeved on and connected threadedly to said threaded end portion of said adjusting member, and mounted rotatably on said housing, said operating ring being rotatable relative to said threaded end portion of said adjusting member so as to cause movement of said adjusting member relative to said operating ring in the axial direction.

6. The powder-actuated fastener-driving device as claimed in claim 5, wherein said adjusting member further has an intermediate portion interconnecting and perpendicular to said threaded end portion and said control end portion.

7. The powder-actuated fastener-driving device as claimed in claim 5, wherein said housing includes a mounting panel formed with a mounting hole for mounting said operating ring of said power adjusting unit therein such that said operating ring is partially exposed from said mounting panel via said mounting hole.

8. The powder-actuated fastener-driving device as claimed in claim 7, wherein:

said mounting panel is further formed with an indicating hole; and said power adjusting unit further includes an indicator connected to one end of said threaded end portion of said adjusting member and partially exposed from said mounting panel via said indicating hole for indicating power information based on movement of said adjusting member.

9. The powder-actuated fastener-driving device as claimed in claim 1, wherein said control end portion of said adjusting member of said power adjusting unit has a frusto-conical front end.

10. The powder-actuated fastener-driving device as claimed in claim 1, wherein said control end portion of said adjusting member of said power adjusting unit has a front end with a chamfer.

* * * * *